United States Patent [19]

McClurg

[11] 3,940,249

[45] Feb. 24, 1976

[54] LABORATORY TESTING PROCEDURE

[75] Inventor: James E. McClurg, Omaha, Nebr.

[73] Assignee: Streck Laboratories, Inc., Omaha, Nebr.

[22] Filed: June 17, 1974

[21] Appl. No.: 479,823

Related U.S. Application Data

[63] Continuation-in-part of Ser. No. 364,953, May 29, 1973, abandoned.

[52] U.S. Cl. ..... 23/230 R; 23/259; 23/292; 62/371; 62/457; 165/104 R

[51] Int. Cl.[2]... B01L 9/06; F25D 3/08; F28D 13/00

[58] Field of Search ..... 23/230 R, 259 R; 62/4, 62/371, 457; 252/70; 165/104

[56] References Cited

UNITED STATES PATENTS

| | | | |
|---|---|---|---|
| 1,677,276 | 7/1928 | Deicken | 220/13 X |
| 1,861,957 | 6/1932 | DeRemer | 252/70 |
| 1,985,632 | 12/1934 | Fleischer | 252/70 |
| 2,716,068 | 8/1955 | Fain | 252/70 |
| 3,034,305 | 5/1962 | Ruggieri | 62/4 |
| 3,072,362 | 1/1963 | Allen | 23/292 X |
| 3,161,031 | 12/1964 | Flannery | 62/457 |
| 3,369,369 | 2/1968 | Weiss | 62/371 |
| 3,373,581 | 3/1968 | Strader | 62/371 |
| 3,505,023 | 4/1970 | VanDamme | 23/259 |
| 3,607,134 | 9/1971 | McIntyre | 23/292 |
| 3,678,703 | 7/1972 | Cornish | 62/457 |
| 3,802,220 | 4/1974 | Pompo | 62/457 |

*Primary Examiner*—Morris O. Wolk
*Assistant Examiner*—Dale Lovercheck
*Attorney, Agent, or Firm*—Dawson, Tilton, Fallon & Lungmus

[57] ABSTRACT

A laboratory testing procedure wherein test tubes are uniquely supported under conditions of refrigeration, the test tubes being placed in a generally vertical position with only the test tube bottom portions in contact with the top surfaces of a closed refrigerant reservoir having heat-absorbing means confined therein.

1 Claim, 5 Drawing Figures

LABORATORY TESTING PROCEDURE

This application is a continuation-in part of U.S. application Ser. No. 364,953, filed May 29, 1973 now abandoned.

BACKGROUND AND SUMMARY OF INVENTION

In certain laboratory tests, it is necessary to maintain specimens at a stable low temperature for a considerable length of time. The present practice is to place a few drops of the specimen in a test tube and place the test tube in crushed ice. Frequently, a number of test tubes are placed in the same crushed ice container which results in water from the melted ice adhering to the bottoms of the test tubes. Thereafter, when a test tube is removed for further processing, the drops of water about it may fall downwardly into the remaining test tubes, thereby introducing foreign material into those test tubes remaining.

Further, there is always a question of whether all of the test tubes are subjected to uniform temperature conditions — this being significant to provide reproducibility of results, as in an assay or the like. This is particularly important in binding interactions where the affinity constant increases as the temperature decreases, i.e., approaches 0°C.

Through the practice of the invention, the objectionable drawbacks of the prior art are avoided and a number of advantages provided. More particularly, in the practice of the invention, the test tubes are mounted in a unique fashion in a holder which includes a base portion and a superstructure portion integral therewith. The base portion includes a sealed container substantially filled with a freezable liquid and has a top surface equipped with recesses to receive the bottom portions of test tubes. The superstructure has a plurality of apertures therein aligned with the aforementioned recesses for supporting and stabilizing the test tubes a spaced distance above the base portion.

Other advantages of the invention may be seen in the details of operation and construction set down in the ensuing specification.

DETAILED DESCRIPTION

The invention is described in conjunction with the accompanying drawing, in which FIG. 1 is a perspective view of apparatus embodying teachings of the invention;

Figure 1:
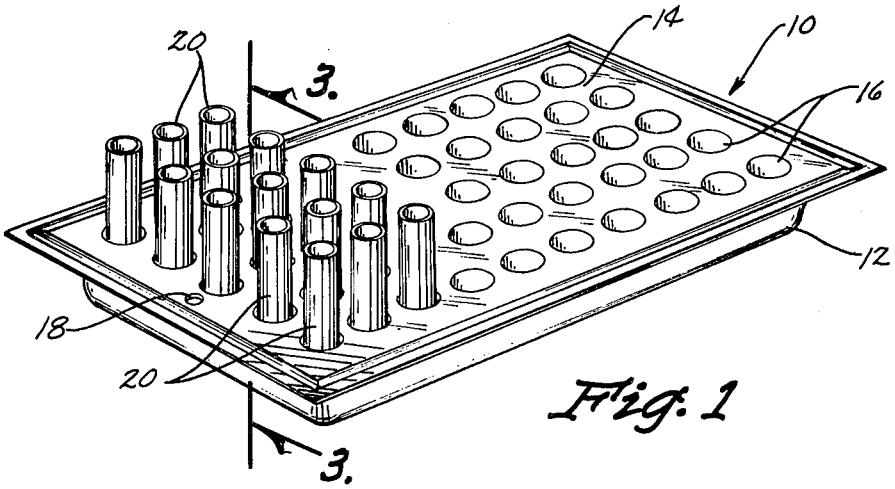
Figure 2:
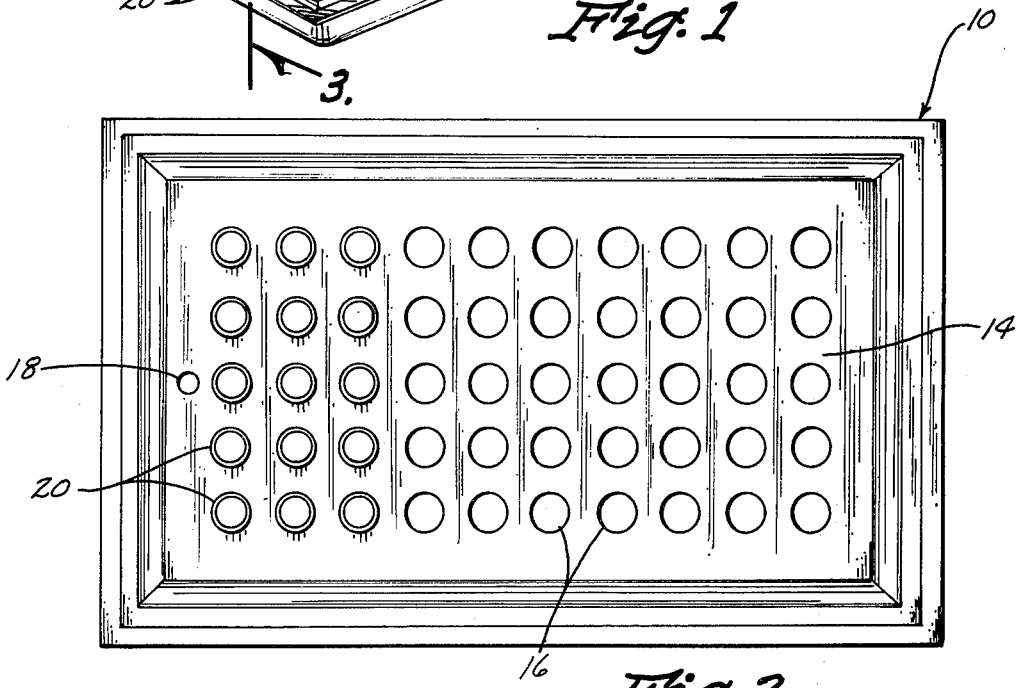
FIG. 2 is a top view of the apparatus of FIG. 1.
Figure 3:
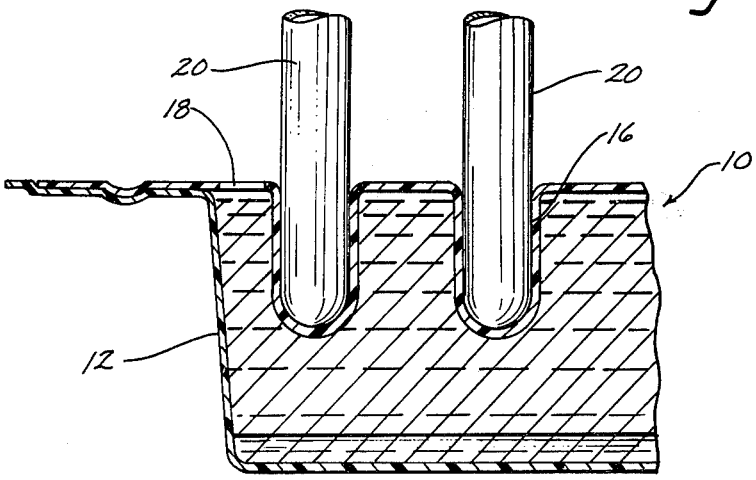
FIG. 3 is a sectional view such as would be seen along the line 3—3 of FIG. 1.

Referring first to the showing in FIGS. 1–3 (first page of drawing), one apparatus employed in the practice of the invention is referred to generally by the reference numeral 10 and includes a bottom housing 12 having a top member secured to the upper periphery thereof in a sealed manner and extending there across.

The top member 14 is provided with a plurality of spaced apart receptacle supports or recesses which extend downwardly into the bottom housing 12 as illustrated in FIG. 3. In this embodiment, the receptacle supports 16 are constructed and arranged to receive test tubes as at 20, the closed unit developed by the cooperation of the housing 12 and top member 14 being equipped with a fill opening 18.

The apparatus 10 is advantageously contructed of a thermoplastic material with the top member 14 being heat sealed or otherwise secured to the bottom housing 12. The closable fill opening 18 is provided in the top member 14 for filling the holder 10 with a freezable liquid such as water. As seen in FIG. 3, the frozen water embraces each of the receptacle supports 16 and thereby refrigerates any specimen contained within the test tubes 20.

Figure 4:
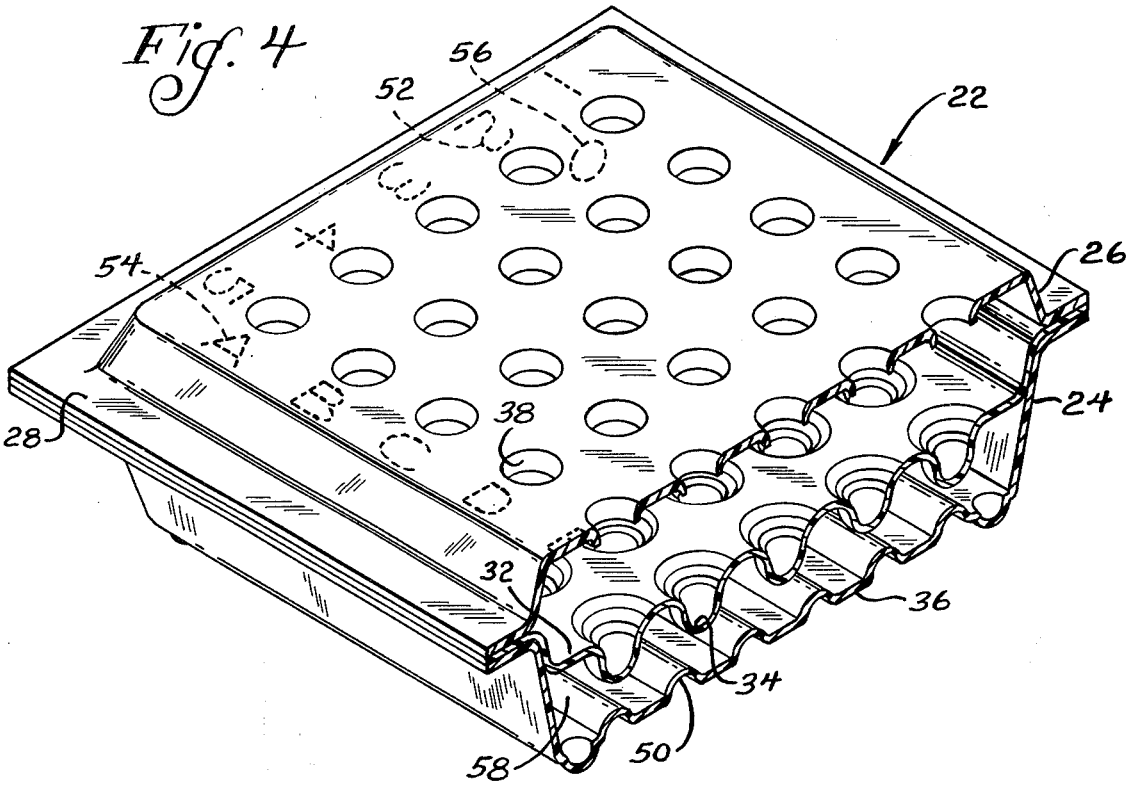
FIG. 4 is a fragmentary perspective view of a modified form of apparatus employed in the practice of the invention with a portion cut away to show the details of construction.
Figure 5:
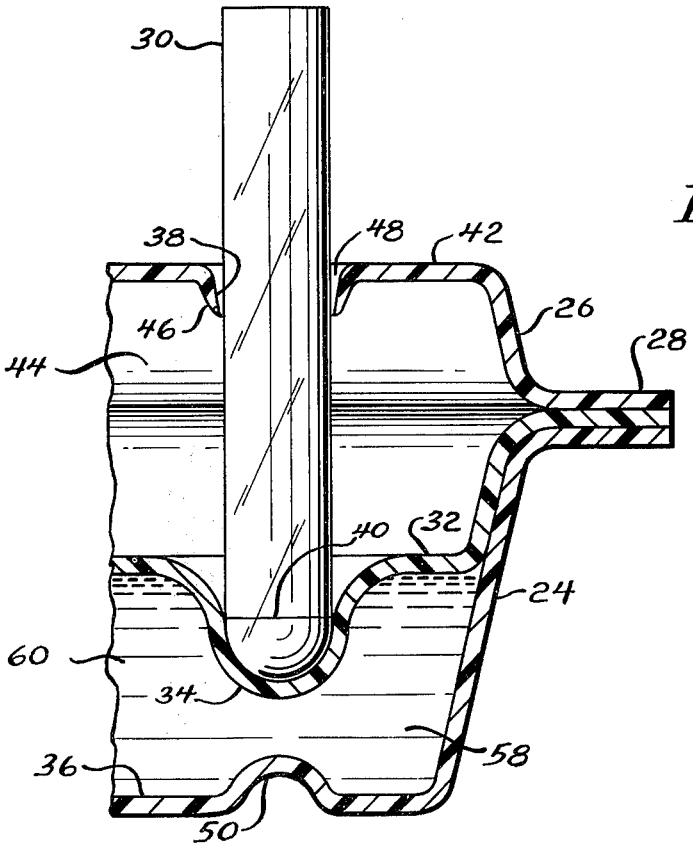
FIG. 5 is an enlarged fragmentary sectional view of the showing in FIG. 4.

A second and preferred embodiment of the invention is seen in FIGS. 4 and 5 (second sheet of drawing). The apparatus shown there is generally designated by the numeral 22 and is seen to include a base or container portion 24. The apparatus 22 also includes a superstructure 26 which is perimetrically secured to the container 24 as at 28. As seen in FIG. 5, a test tube 30 is advantageously supported both by the base portion 24 and by the superstructure 26.

For this purpose, the base portion 24 has a top 32 which is equipped with a plurality of recesses or dimples as at 34 which project downwardly toward the bottom wall 36. The superstructure 26 is equipped with a plurality of apertures 38 which are aligned with the recesses 34.

In the practice of the invention, a test tube (as at 20 or 30) may be employed in a radioimmunoassay. These assays are commonly employed to detect small levels of hormones and many other substances. In such testing a small quantity of the specimen, i.e., less than 1 milliliter has to be maintained in the temperature range 0°–4°C. from 4 to 6 hours. It is not uncommon for the specimen to have a volume of 0.2 milliliters, i.e., a few drops where the average drop size is 0.05 milliliters. Thus, it will be appreciated that the level of the specimen within the test tube 20 or 30, as the case may be, is near the test tube bottom, i.e., at the level designated 40 in FIG. 5. In other words, with a test tube 30 which may have a height of 75 millimeters, the liquid specimen occupys only the lowest few millimeters. By constructing the recess 34 to have an interior depth of the order of 10–15 millimeters, I insure that the level 40 is substantially embraced by a heat transfer surface, viz., the top 32. Further, the superstructure 26 provides a support for the test tube 30 a spaced distance above the heat transfer surface made up of the top wall 32. In the illustration given the distance between the top wall 42 of the superstructure 26 and the top 32 of the base portion 24 is of the order of 30–35 millimeters. Advantageously, the superstructure supports the test tube 30 at a point at least a quarter of its height above the heat transfer surface 32. In addition to providing a support or stabilization, the superstructure 26, in combination with the top 32 of the base portion 34 provides a dead air space as at 44 (see FIG. 5) which affords additional insulation. This effectively precludes condensation on the test tube and further serves to avoid the problem of contamination of other test tubes, referred to previously. It will be appreciated that because of the very small volume of the specimens, it is unnecessary to have a recess 34 of sizable depth, particularly when the additional stabilization provided by the superstructure 26 is taken into account.

In the preferred form of the invention, the walls, i.e., the members 32, 36 and 26 are all constructed of a plastic material such as acrylonitrile-butadiene-styrene (ABS) having a thickness of the order of 0.060 inches, i.e., about 1.5 millimeters. The top 42 is equipped with a depending cylindrical flange 46 (see FIG. 5) further defining each aperture 38 and it will be appreciated that although the inside diameter of the flange 46 is greater than the outside diameter of the test tube 30 (to provide an annular space 48), there can be developed an advantageous wiping action on the test tube 30 should any condensation occur thereon.

The bottom wall 36 of the base portion 24 is equipped with a plurality of longudinally extending grooves 50 which serve to rigidify the apparatus 22. An especially advantageous size of apparatus (to accommodate 50 test tubes) measures 14 inches in length by 9 inches in width by 3 inches in height. In the illustration given, the length dimension is in the direction of the grooves 50. To assist the laboratory technician in identifying the various test tubes, I have embossed in the top wall 42 indicia as at 52 (see FIG. 4) and consisting of the numbers 1–5. Further embossed along the length of the apparatus 22 are the further indicia 54 (consisting of the letters A-J). Thus, the laboratory technician need only jot down the coordinates in terms of the indicia 52-54 to identify a given test tube.

Referring to FIG. 4, the numeral 56 (in the upper central portion thereof) designates a fill opening (corresponding to the open 18 previously referred to). The opening 56 is closed by a removable stopper (not shown) and permits the introduction of a freezable fluid into the base portion 24. The base portion 24 has a hollow interior 58 defined by the cooperation of the top and bottom walls 32 and 36 which are perimetrically united as at 28. As seen in both FIGS. 4 and 5, each of the three wall providing portions 32, 36 and 42 has a perimetric flange and the ABS material is conveniently fused or united by using methyl-ethyl-ketone which is a solvent for ABS. Thus, the superposed flanges (in the area 28) are effectively integrated.

In the preferred practice of the invention, a water solution is employed. The solution includes water and a material having colligative properties relative to water, i.e., reduces the freezing point and the swelling of the water crystal via reduction of inter molecular spacing. This prevents uneven swelling of the water at freezing which produces bulging of the unit. Useful for this purpose is sodium chloride or ethylene glycol. Through the use of such an aqueous solution, in the range of 0.05 molar to 0.5 molar, it is possible to avoid undue bulging of the base portion 24 incident to the freezing of the aqueous solution. In the illustration given, the interior volume of the base portion or container 24, i.e., the space 58, is approximately 1600 milliliters. To accommodate the swelling, approximately 1300 milliliters of the aqueous solution is introduced.

Normally the apparatus 22 is filled with liquid at the time of sale so that it is ready for introduction into the laboratory freezer. To prepare the apparatus for use, it is merely necessary to place it in a level position in a freezer overnight to freeze the aqueous solution 60 which is confined within the space 58 of the base portion or container 24. Then, for use, it is merely necessary to remove the apparatus from the freezer and use the same at room temperature on a laboratory bench. This is done by inserting the test tubes in the assay in the apertures 38. The test tubes 30 thus are automatically directed into the recesses 34 and are in stable condition. The temperature of the contents of the test tubes 30 is maintained in the range of 0.4°C. for up to 8 hours at normal room temperature. In the event the unit is used in refrigerator temperatures (5°–12°C), it is capable of maintaining a plurality of test tubes at a stable temperature for from 2–4 days. When not in use, the apparatus 22 is conveniently stored in the freezer so that it is always ready to be used.

If for some reason, the liquid 60 should leak out of the apparatus 22 or be accidentally drained, the apparatus is conveniently refilled – merely by removing the stopper installed in the fill opening 56 and adding approximately 1,300 milliliters of water containing a material having colligative properties such as salt, sugar, ethylene glycol, etc.

It will be seen from the foregoing that the apparatus is always ready for use in practicing the invention. It can be stored in the freezer when it is not being used and eliminates the difficulty of prior art procedures in having to provide crushed ice. This is especially advantageous for laboratories which do not have a source of crushed ice.

While in the foregoing specification a detailed description has been set down for the purpose of explanation, many variations in the details hereingiven may be made by those skilled in the art without departing from the spirit and scope of the invention.

I claim:

1. A laboratory testing procedure for specimens under refrigeration comprising the steps of providing a test tube holder apparatus which includes a container having a bottom, walls extending upwardly from said bottom, and a top secured to and extending across the upper ends of said walls, said top having a plurality of spaced apart supports integrally formed therein extending downwardly therefrom toward said bottom for removably supporting the bottom portions of test tubes therein, said container being substantially filled with a freezable liquid material comprising $H_2O$ and a material having colligative properties relative to $H_2O$, said container being equipped with a superstructure mounted a spaced distance above said top and equipped with an aperture aligned with each of said supports whereby a test tube is supported at two vertically spaced apart positions, said superstructure including a unitary member having a top panel with depending sidewalls, said sidewalls being connected to the perimeter of said container, said superstructure being positioned above said top a distance to support a test tube at at least one-quarter of the test tube height, selectively introducing liquid materials to be tested into a plurality of test tubes, placing said test tubes in generally vertical position with only the test tube bottom portions in contact with said top supports whereby the material in said container is adapted to maintain the materials in said test tube at a temperature below about 4°C. for up to about 8 hours and while said apparatus is in ambient room temperature, maintaining said portions in heat transfer contact with said top, thereafter selectively withdrawing said test tubes from said contact for further testing, and analytically testing the contents of said test tubes.

* * * * *